United States Patent [19]

Rooney et al.

[11] Patent Number: 4,503,415

[45] Date of Patent: Mar. 5, 1985

[54] ENCAPSULATED HOT SPOT FUSE LINK

[75] Inventors: William J. Rooney, Clifton; Francis J. Rooney, Ramsey, both of N.J.

[73] Assignee: Commercial Enclosed Fuse Co. of NJ, North Bergen, N.J.

[21] Appl. No.: 501,406

[22] Filed: Jun. 6, 1983

[51] Int. Cl.[3] ..... H01H 85/04

[52] U.S. Cl. ..... 337/160; 337/166; 337/296

[58] Field of Search ..... 337/160, 166, 296

[56] References Cited

U.S. PATENT DOCUMENTS 2,808,487 10/1957 Jacobs, Jr. ..... 337/296

*Primary Examiner*—Harold Broome

*Attorney, Agent, or Firm*—Arthur L. Plevy

[57] ABSTRACT

There is disclosed an encapsulated fuse link whereby a lower melting point metal such as tin is deposited between two reduced cross sectional areas of a higher melting point base material such as copper or silver which forms the major surface area of the link. The area upon which the lower melting point metal is deposited is encapsulated by means of nonconductive material such as a high temperature plastic tube which is secured to the major surface of the link by some means such as staples at either end. The structure prevents the low melting point metal from migrating or traveling down the fuse link during operation which would undesirably tend to alter the characteristics of the fuse.

12 Claims, 3 Drawing Figures

ENCAPSULATED HOT SPOT FUSE LINK

BACKGROUND OF THE INVENTION

This invention relates to fuses, to electrical fuses in general and more particularly to an improved link for an electrical fuse. Essentially, there are many fuses which exist on the market where a manufacturer will deposit a globule or a low melting metal on a fuse link. The purpose for this is to reduce the temperature at which the link will melt whereby the lower melting metal provides a hot spot on the link which becomes the point at which the fuse will open under overload. For example, many links are fabricated from copper which is a good conductor and has a relatively high melting point. In providing a fuse with a lower melting point, manufacturer may deposit a globule or a rivet fabricated from selenium, germanium, indium or tin. For example, copper melts at 1600° F. while tin has a melting point of about 1300° F. A composite link fabricated from copper with a tin globule or rivet will have a reduced melting point between 400° F. to 600° F. depending upon the concentration of the low melting temperature metal on the link.

This technique, as indicated, has been widely employed in the prior art. This is known as the M effect. There is a problem with the M effect at certain overload conditions. What occurs is that as the fuse is being operated under overload conditions, the copper heats up and the tin tends to move or creep towards the hot spots of the fuse link which are normally associated with reduced cross sectional areas of the link. Under normal circumstances, this would disolve the copper in the reduced cross sections causing them to get extremely hot aand completely melt. This causes the fuse to open which is the desired result.

It has been found that this is not always the case. Under very small overloads, the tin will migrate to the reduced cross sections as described above, but it will migrate in such small amounts that it will not affect the operation of the reduced cross section that the tin has migrated to. The tin will then continue to migrate down the link until it has reached a relatively uniform concentration down the entire link. The end result of this is that the fuse will never open under overload conditions and this will adversely effect the short circuit operation. The migration of the low melting point metal completely changes the characteristics of the fuse.

In this manner, the hot spot point in the fuse link which as indicated occurs at the reduced cross sectional areas of the link draws the low melting point metal down the link further causing the same to absorb into the copper. This completely changes the characteristics of the fuse, and hence the area in which the low melting point metal was placed does not have enough of the metal due to the migration of the same, and therefore the fuses will not operate as designed. Essentially, it is an object of this invention to provide a means for retaining the low melting point material in the desired area of the copper fuse link and hence to prevent migration of the metal towards the ends of the fuse.

In order to do so, the area which is designated by the low melting point metal is encapsulated by means of a non-conductive high temperature plastic enclosure. The encapsulated section completely defines a predetermined hot spot for the fuse and prevents the low melting point metal which is deposited on the link from moving down the link to thereby alter the characteristics of the same.

There are many patents in existence which show a fuse having an encased element for various purposes. For example, U.S. Pat. No. 2,543,245 entitled Fuse Construction issued on Feb. 27, 1951 to G. F. Laing. This patent shows a fuse having an eutectic alloy element which is separately encased between two partition walls with each element end connected to a suitable link member.

U.S. Pat. No. 2,561,464 entitled Time Lage Fuses issued on July 24, 1951 to M. Cremer discloses a fuse which has an alloy in the form of a spherical mass positioned on a reduced cross sectional area of the element. This area is further isolated by means of partition walls.

Another patent, U.S. Pat. No. 2,577,531, entitled Fuse Construction issued on Dec. 4, 1951 by G. F. Laing shows a dual element fuse in which the links have a higher melting point than the central portion which is also an eutectic alloy and is similar in construction to the fuses shown in U.S. Pat. No. 2,577,531.

Other patents such as U.S. Pat. Nos. 3,701,069 and 3,721,935 show various fuse constructions which consist of a central element separated by an insulating casing from a fuse link. In any event, all these fuses are composite fuses. That is to say, the fuses include dual elements or can be represented by dual elements which are composite materials secured to central link arrangement. None of the prior art references depicted show a fuse construction which prevents the above noted problem in an efficient and reliable manner.

BRIEF DESCRIPTION OF THE PREFERRED EMBODIMENT

A composite fuse link assembly of the type employing a main planar link member of a conductive metal adapted to be positioned between to terminals of a fuse structure, said link having a pattern of reduced cross sectional areas along the surface thereof the improvement in combination therewith of an encapsulated hot spot area for said link comprising a globule of a conductive metal deposited on said link member and symmetrically disposed between two adjacent reduced cross sectional areas, an insulative tubular member having first and second opened ends positioned about said globule and said link, means for securing said tubular member at said first and second opened ends to said link at said larger areas of said link, to prevent said conductive metal of said globule from undesirably traveling down said link during fuse operation.

DETAILED DESCRIPTION OF THE FIGURES

Figure 1:
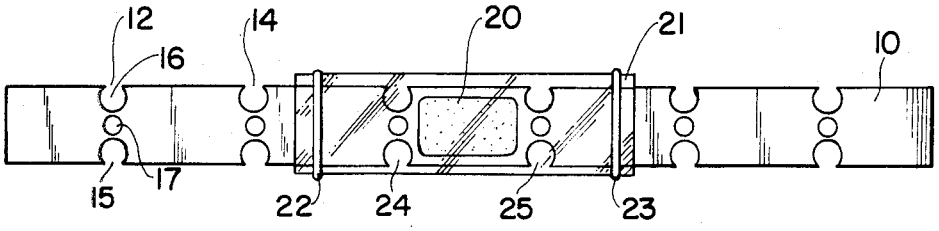
FIG. 1 is a top plan view of an encapsulated fuse link according to this invention.

Referring to FIG. 1, there is shown a fuse link 10. The link 10 is typically fabricated from copper, silver or some other conductive metal which is normally employed for fuse links.

As seen, the link 10 includes a series of separated reduced cross sectional areas such as areas 12 and 14. Essentially each area consists of a uniquely shaped cutout which comprises a top and a bottom circular cutout area as 15 and 16 with a central aperture or hole 17. The aperture as 17 spreads the dispersal of arcs into a quartz sand filler which normally surrounds such a link. Circular cutouts aid in controlling the arc pattern of the fuses. In any event, such link configurations are well known in the art.

For example, see U.S. Pat. No. 4,308,515 entitled Fuse Apparatus for High Electrical Currents by Wm. J. Rooney et al, issued on Dec. 29, 1981 and assigned to the assignee herein. This patent shows a link having reduced cross sectional areas dispersed along the surface of the link in a similar manner to the areas described and shown herein. The reduction in the cross sectional area constitutes a weakening of the fuse link at those points and essentially the metal located between the apertures is more prone to melt and hence cause current interruption.

The use of such apertures to provide a reduction in cross section as indicated is commonly employed in the fuse art. The apertures 12 and 15 which are on the edges of the link constitute approximately $\frac{2}{3}$ of a complete circle. In this manner the tips which abut each other act as an arc gap which enables voltage arcs to jump across the tips. These apertures uniquely operate to broaden the voltage arc during fuse operation, and to prevent the arc from running up or along the edge of the link and also dissipate any stored energy remaining in the system in which the fuse is installed.

As seen in the Figure, a globule 20 of low melting point metal is disposed between two reduced cross sectional areas as 24 and 25. This area 20 symmetrically disposed between the two cross sectional areas. The low melting point metal may be tin, selenium, germanium, or indium. The area 20 may be actually soldered to the copper link or a rivet of such material may be emplaced upon the surface of the link adjacent the two cross sectional areas. The entire area is then encapsulated by a tube of insulating high temperature material, such as that material sold under the name of Kapton which is high temperature plastic.

Figure 2:
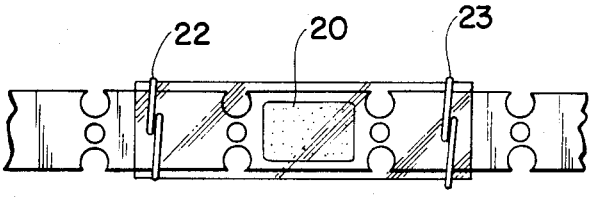
FIG. 2 is a partial plan view of a fuse link depicting the encapsulated area.

The opened ends of the tube are secured to the larger cross sectional area of the link by staple members 22 and 23. Essentially, the staple members are bands of wire which are disposed about the ends of the plastic tube 25 to secure the tube firmly in place as seen from the partial cross sectional view of FIG. 2.

The insulating tube as secured as shown prevents migration of the low melting temperature metal down the link by confining the hot spot of the fuse to the areas which are encapsulated by the plastic tube which prevents the hot spot from contacting the quartz filler. Staples 22 and 23 behave as heat sinks to further prevent migration of the low melting point metal down the link and to preserve electrical characteristics of the link as designed.

The link as shown in FIG. 1 is normally employed within an outer insulating casing wherein each end of the link is connected to terminals associated with the casing. The outer casing or housing is then filled with a quartz sand or arc quenching filler which is also shown in the above noted patent as well as many other patents.

Essentially, the above apparatus prevents the low melting metal such as tin from migrating or traveling down fuse links during fuse operation. Thus, the encapsulation of the area by the thin plastic cylinder provides a hot spot for the fuses while preventing the lower melting point material from moving down the link to thereby undesirably alter the operating characteristics of the final fuse assembly.

Figure 3:
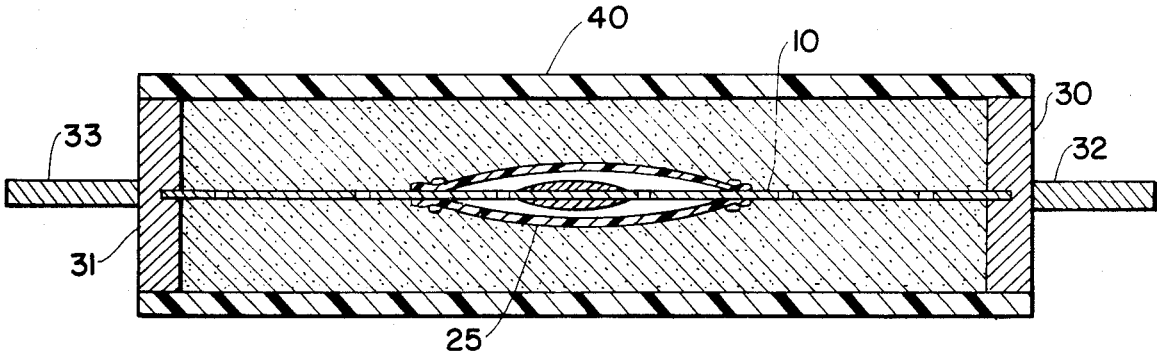
FIG. 3 is a side elevational view in partial cross section depicting a fuse assembly employing the composite link according to the invention.

Referring to FIG. 3, there is shown a typical fuse construction employing the composite link as described above. Essentially, the ends of the link are inserted into two conductive disk-like terminal ends 30 and 31 which are associated with outer terminal sections as 32 and 33 for connecting the fuses in circuit.

A outer casing 40 which is cylindrical in shape is fabricated from a insulative plastic or paper material and serves as a housing for the fuse. The element 10 is disposed as shown in the Figure between terminals 32 and 33. The inner holder of the housing 40 may then be filled with a quartz sand or other type of arc quenching filler. As can be seen from FIG. 3, the encapsulated area as described above is isolated from the sand by means of the plastic tube covering 25. It is of course understood that many alternative configurations for fabricating a fuse structure utilizing this link will be apparent to those skilled in the art.

We claim:

1. A composite fuse link assembly of the type employing a main planar link member of a conductive metal adapted to be positioned between two terminals of a fuse structure, said link having a pattern of reduced cross sectional areas along the surface thereof, the improvement in combination therewith of an encapsulated hot spot area for said link, comprising:

a globule of a conductive metal deposited on said link member and symmetrically disposed between two adjacent reduced cross sectional areas wherein each of said reduced cross sectional area comprises a central aperture in said link with a first two-thirds circular cutout located above said aperture and with a second two-thirds circular cutout located below said aperture with said globule located on a flat portion of said link between said reduced cross sectional areas, an insulative tubular member having first and second opened ends postioned about said globule and said link, heat sink means for securing said tubular member at said first and second opened ends to said link at said larger areas of said link, to prevent said conductive metal of said globule from undesirably traveling down said link during fuse operation.

2. The fuse link assembly according to claim 1, wherein said link is fabricated from copper.

3. The fuse link assembly according to claim 1, wherein said globule of metal has a lower melting point than the metal employed in said link.

4. The fuse link assembly according to claim 1, wherein said globule of metal is tin.

5. The fuse link assembly according to claim 1, wherein said globule of metal is selenium.

6. The fuse link assembly according to claim 1, wherein said globule of metal is germanium.

7. The fuse link assembly according to claim 1, wherein said globule of metal is indium.

8. The fuse link assembly according to claim 1, wherein said insulative tubular member is fabricated from a high temperature plastic.

9. The fuse link assembly according to claim 1, wherein said heat sink means for securing said tubular member to said link includes a first conductive band member surrounding and closing said first opened end about said link at a larger area location and a second conductive band member surrounding and closing said second opened end about said link at another larger area location.

10. A method of preventing the migration of a low melting point metal deposited upon a higher melting point link with said link having a repeated pattern of reduced cross sectional areas manifesting areas which heat up more rapidly during a current flow through said link, said low melting point metal undesirably migrating towards said areas to alter the electrical characteristics of said link comprising the steps of:

depositing said low melting point metal between two adjacent reduced cross sectional areas, said reduced cross sectional areas each having a central aperture with a first two-thirds circular cutout located above said aperture and with a second two-thirds circular cutout located below said aperture, encapsulating said deposited low metal point area with a thin tubular insulating plastic member, and securing said member at each end to said link at the larger cross sectional areas of said link, where said thin tubular insulating member completely encloses said low metal point metal and said two adjacent reduced cross sectional areas as including said apertures to prevent said low melting point metal from migrating towards said areas.

11. The method according to claim 10, wherein said low melting point metal is tin with said link being copper.

12. The method according to claim 10, wherein said steps of securing said member is accommodated by staples surrounding and closing the ends of said tubular member to secure the same to said link.

* * * * *